US007494247B2

(12) United States Patent
Wen

(10) Patent No.: US 7,494,247 B2
(45) Date of Patent: Feb. 24, 2009

(54) HID SEARCHLIGHT MODULE

(76) Inventor: Chin-Sheng Wen, 3/F., No. 9, Lane 183, Kuangfu Rd., Sec. 1, Sanchung City, Taipei County (TW)

( * ) Notice: Subject to any disclaimer, the term of this patent is extended or adjusted under 35 U.S.C. 154(b) by 0 days.

(21) Appl. No.: 12/073,070

(22) Filed: Feb. 29, 2008

(65) Prior Publication Data

US 2008/0253114 A1 Oct. 16, 2008

Related U.S. Application Data

(60) Provisional application No. 60/923,065, filed on Apr. 12, 2007.

(51) Int. Cl.
*F21L 4/00* (2006.01)

(52) U.S. Cl. ..... 362/263; 362/157; 362/205

(58) Field of Classification Search ..... 362/263, 362/157, 205, 208
See application file for complete search history.

(56) References Cited

U.S. PATENT DOCUMENTS

| | | | | |
|---|---|---|---|---|
| 6,573,665 | B2 * | 6/2003 | Cooper et al. | 315/291 |
| 7,311,417 | B1 * | 12/2007 | Lemke | 362/158 |
| 2004/0042211 | A1 * | 3/2004 | Jigamian et al. | 362/263 |
| 2004/0136192 | A1 * | 7/2004 | Saieva | 362/263 |

* cited by examiner

*Primary Examiner*—Laura Tso
(74) *Attorney, Agent, or Firm*—Rosenberg, Klein & Lee

(57) ABSTRACT

A HID searchlight module includes lamp head unit, a ballast unit and a battery unit respectively connected to one another in series by a respective screw joint. The lamp head unit has an end cap at the rear side that has two holes, two metal springs respectively mounted in the holes and respectively electrically connected to the contacts of the PC board in the lamp head unit, two metal conducting pins respectively supported on the metal springs, a front inner annular flange protruded from the front side at the center, a front outer annular flange protruded from the front side at the center and concentrically spaced around the front inner annular flange, and an annular coupling groove defined between the front outer annular flange and the front inner annular flange.

8 Claims, 9 Drawing Sheets

HID SEARCHLIGHT MODULE

REFERENCE TO RELATED APPLICATIONS

This Application is based on Provisional Patent Application Ser. No. 60/923,065, filed 12 Apr. 2007, currently pending.

BACKGROUND OF THE INVENTION

1. Field of the Invention

The present invention relates to lighting fixtures and more particularly, to a HID (high intensity discharge) searchlight module that positively isolates the positive electrode from the negative electrode to prevent short-circuit and voltage leakage.

2. Description of the Related Art

FIGS. 10 and 11 show a HID searchlight according to the prior art. According to this design, the HID searchlight 2 comprises a handle 21, which accommodates therein a ballast 22 at the front side and a battery 23 at the rear side, a lamp case 25 provided at the front side of the handle 21, a lamp base 26 mounted in the lamp mounted in the lamp case 25 and holding a HID lamp 252, a reflector 251 mounted in the lamp case 25 around the HID lamp 252, and a PC board 261 mounted in the rear side of the lamp base 26. The HID lamp 252 has a positive electrode 222 disposed at the center of the PC board 261 and a negative electrode 263 disposed at one side of the PC board 261. The positive electrode 222 is electrically connected with the ballast 22 to a positive spring 262 at a plate member 221. The negative electrode 263 is connected with a lead wire 24. The other end of the lead wire 24 is inserted through the handle 21 and electrically connected to a power switch 27 at the rear side of the handle 21. The power switch 27 controls power on/off.

The aforesaid prior art HID searchlight is still not satisfactory in function because of the following drawbacks:

1. Because the lead wire is inserted through the full length of the handle and electrically connected between the negative electrode of the HID lamp at the front side of the handle and the power switch at the rear side of the handle, the handle is not detachable, complicating battery replacement operation.

2. The positive electrode and the negative electrode are simply kept apart at a distance, no isolation means is provided to isolate the positive electrode from the negative electrode. Therefore, a short-circuit may occur during discharging of a high voltage.

3. Because the power switch is provided at the rear side of the handle, the user must use the other hand to operate the power switch when holding the handle with one hand.

SUMMARY OF THE INVENTION

The present invention has been accomplished under the circumstances in view to provide a HID searchlight module that eliminates the aforesaid drawbacks. It is therefore the main object of the present invention to provide a HID searchlight module, which positively isolates the positive electrode from the negative electrode, preventing short-circuit and leakage of high voltage. It is another object of the present invention to provide a HID searchlight module, which is detachable and convenient to use.

To achieve these and other objects of the present invention, the HID searchlight module comprises a lamp head unit, a ballast unit, and a battery unit. The lamp head unit comprises a lamp case, a lamp base mounted in the lamp case, a reflector fastened to a front side of the lamp base, a HID lamp installed in the lamp base within the reflector, a PC board disposed at a rear side of the lamp base, the PC board having a positive contact at the center thereof and a negative contact at one side thereof, and a lamp head end cap provided at a rear side of the PC board. The lamp head end cap comprises two holes corresponding to the positive and negative contacts of the PC board, two metal springs respectively mounted in the holes and respectively electrically connected to the contacts of the PC board, two metal conducting pins respectively supported on the metal springs, a front inner annular flange protruded from a front side thereof at the center, a front outer annular flange protruded from the front side at the center and concentrically spaced around the front inner annular flange, and an annular coupling groove defined between the front outer annular flange and the front inner annular flange. The ballast unit is connectable to the lamp case in a line, comprising a ballast housing, a ballast mounted in the ballast housing for boosting voltage, a power switch mounted in the ballast housing at one side for operation by the user holding the HID searchlight module to switch on/off power supply, and a ballast unit end plate at a front side of the ballast housing for the connection of the lamp head end cap of the lamp head unit. The ballast unit end plate comprises a circular center groove, which receives the front inner annular flange of the lamp head end cap, an annular groove concentrically disposed around the circular center groove, which receives the front outer annular flange of the lamp head end cap, an annular flange disposed between the annular groove and the circular center groove, an annular contact plate mounted in the annular groove, which is kept in contact with one metal conducting pin of the lamp head end cap, and a metal contact mounted in the circular center groove, which is kept in contact with the other metal conducting pin of the lamp head end cap. The ballast has positive and negative terminals thereof respectively and electrically connected to the metal contact and annular contact plate in the ballast unit end plate. The battery unit is connected to one end of the ballast unit opposite to the lamp head unit, comprising a battery housing and a battery mounted in the battery housing.

DETAILED DESCRIPTION OF THE PREFERRED EMBODIMENT

Figure 1:
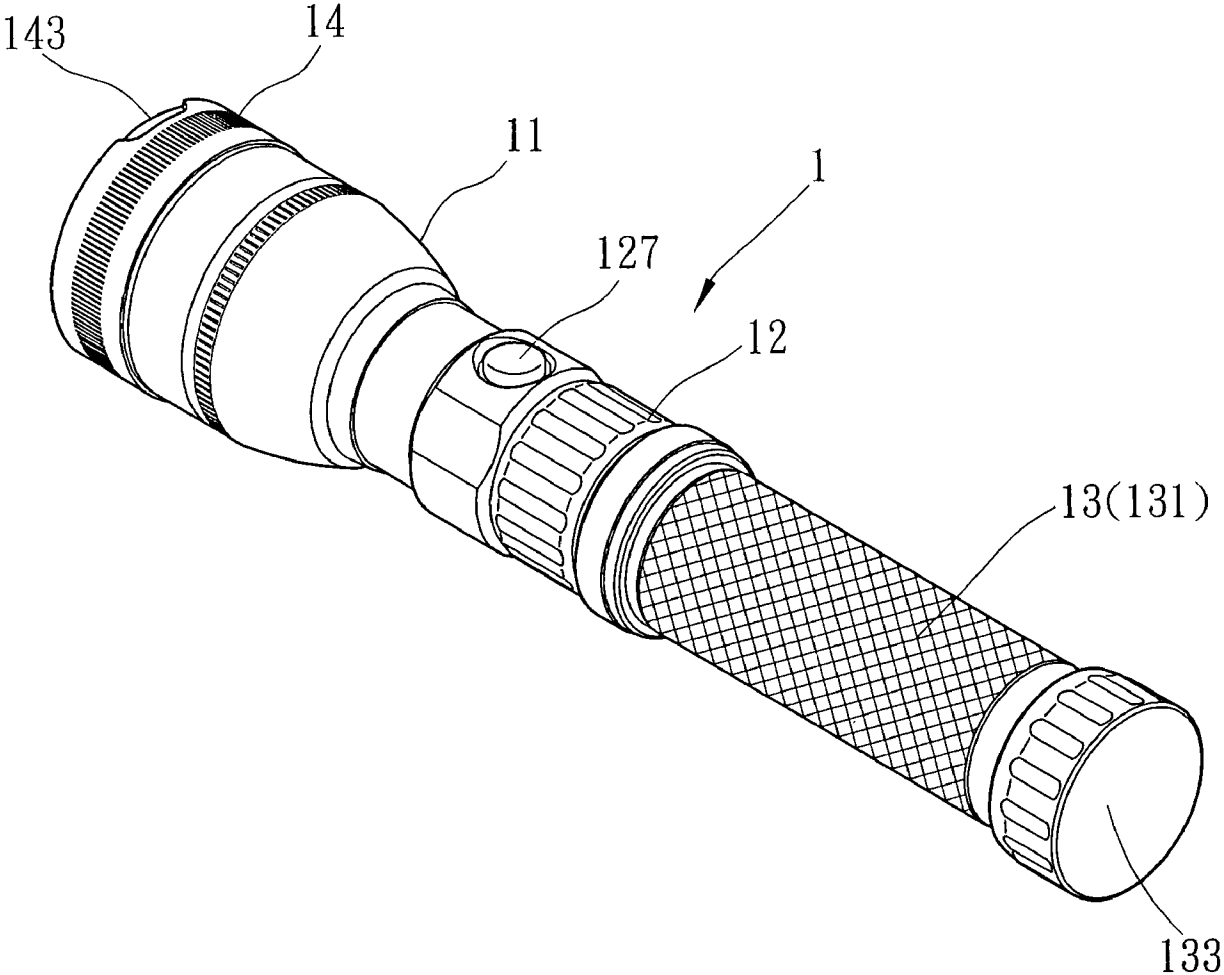
FIG. 1 is an elevational view of a HID searchlight module in accordance a first embodiment of the present invention.
Figure 2:
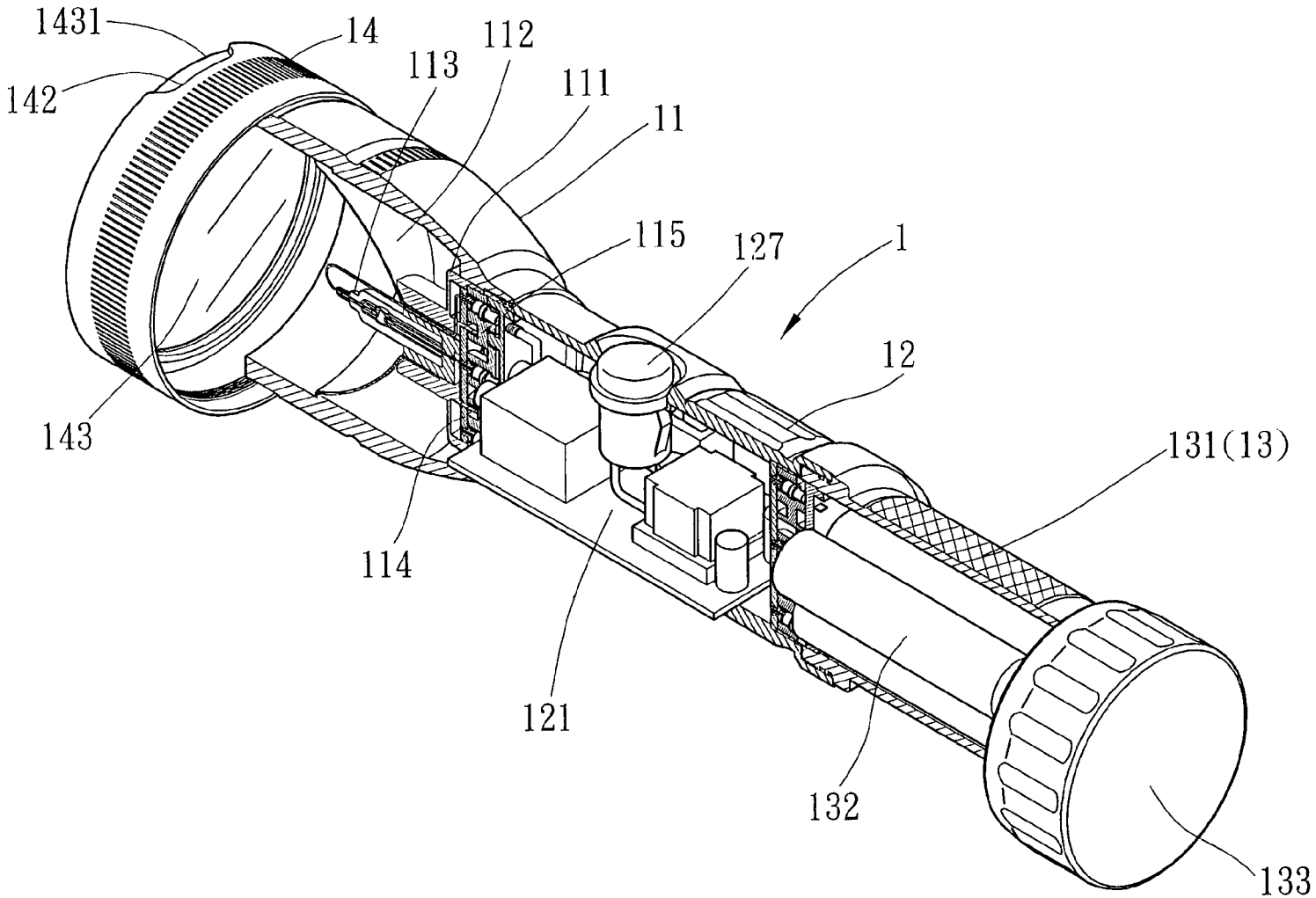
FIG. 2 is a cutaway view of the HID searchlight module in accordance with the first embodiment of the present invention.
Figure 3:
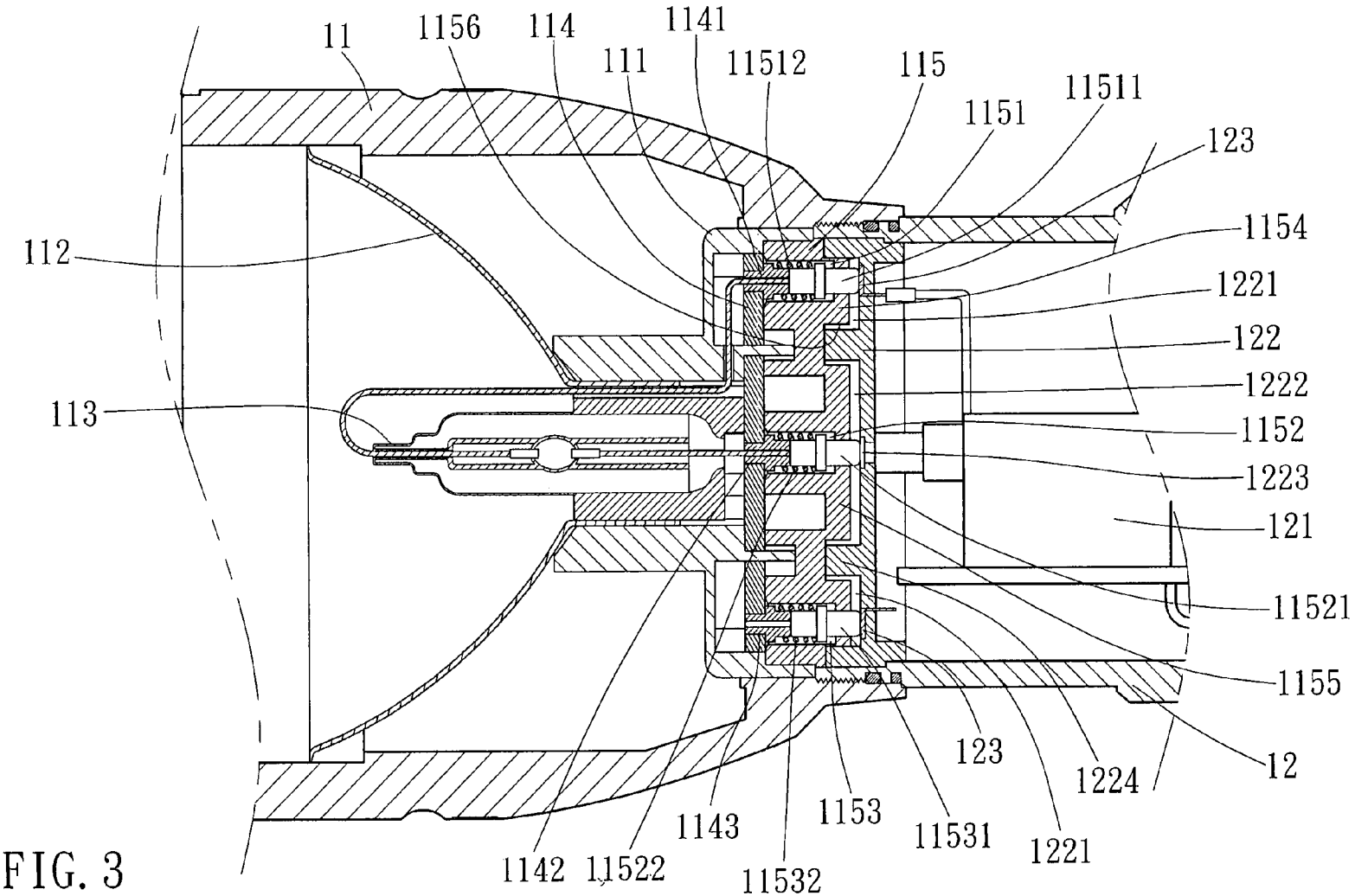
FIG. 3 is a sectional view in an enlarged view of a part of FIG. 1, showing the connection between the lamp head unit and the ballast unit.
Figure 4:
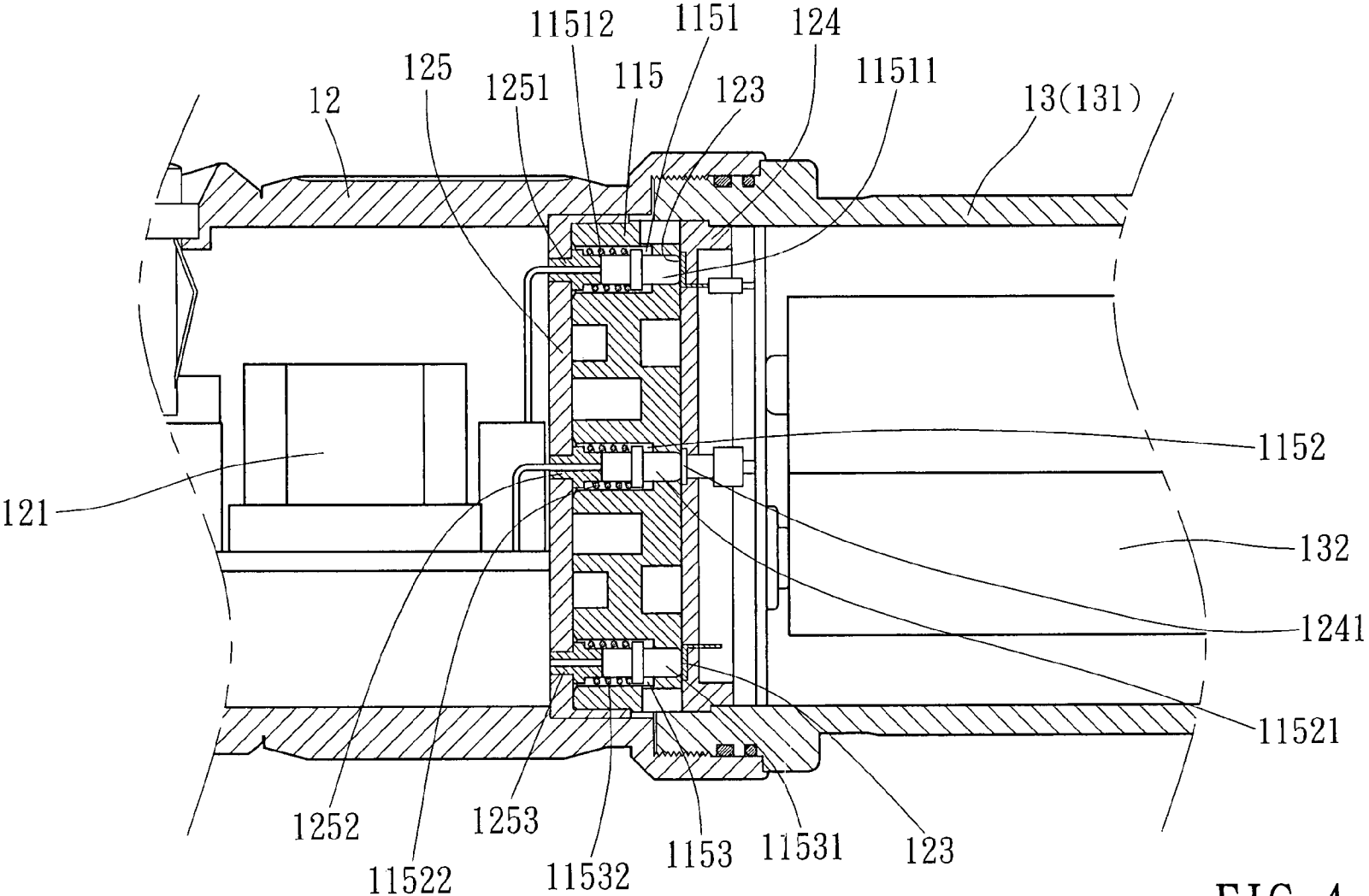
FIG. 4 is a sectional view in an enlarged view of a part of FIG. 1, showing the connection between the ballast unit and the battery unit.
Figure 5:
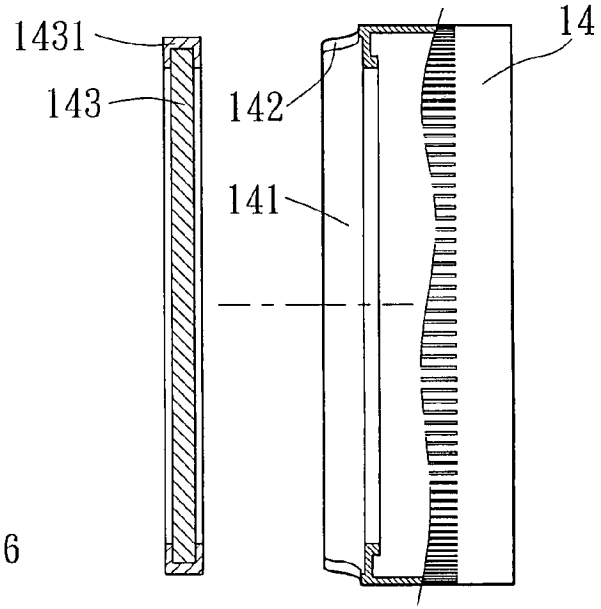
FIG. 5 is an exploded sectional view in an enlarged scale of a part of the first embodiment of the present invention, showing the relationship between the front mounting portion of the lamp case and the filter lens.
Figure 6:
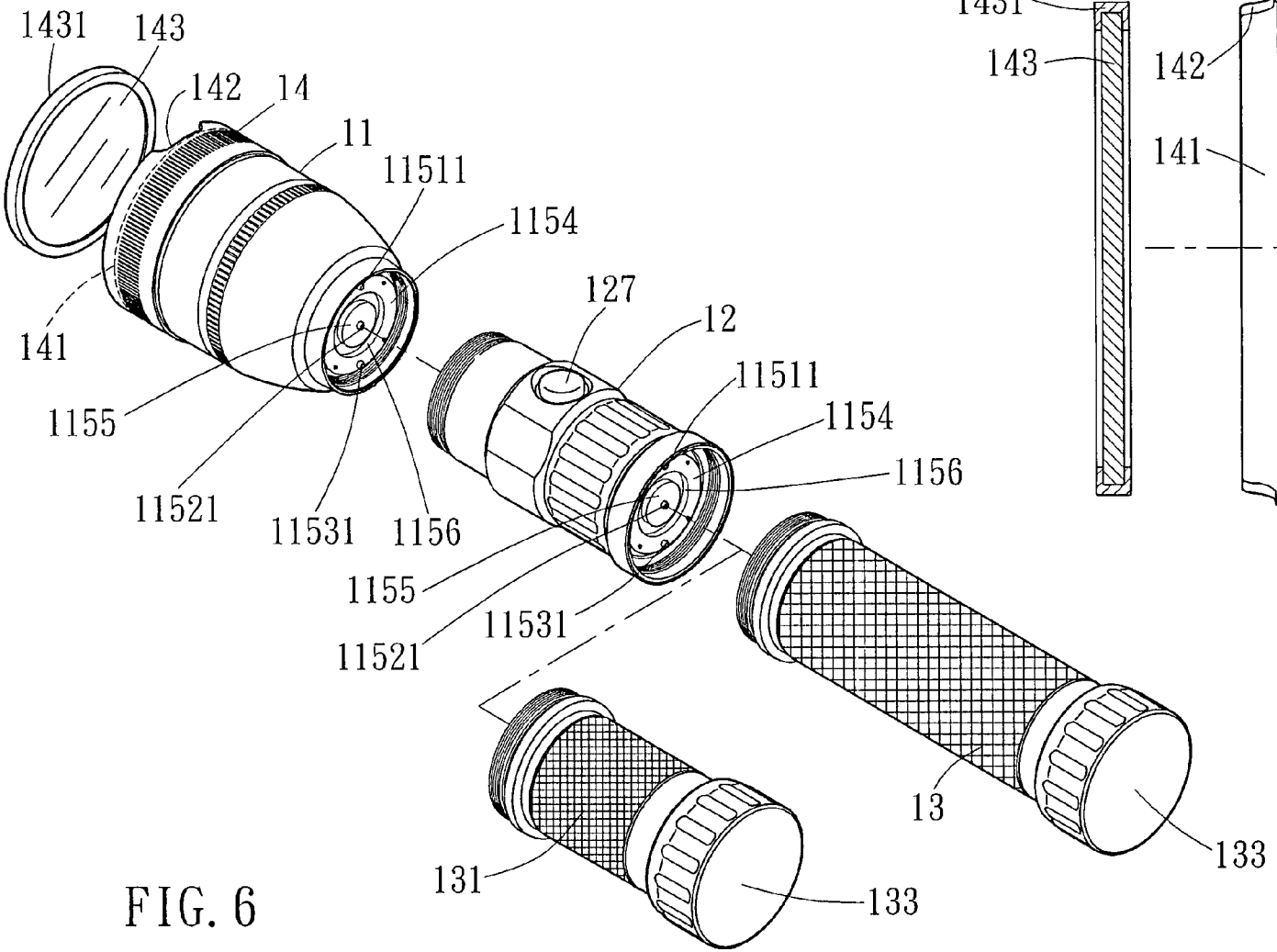
FIG. 6 is an exploded view of the HID searchlight module in accordance with a first embodiment of the present invention.

Referring to FIGS. 1~6, a HID searchlight module 1 in accordance with the present invention is shown comprised of a lamp head unit at the front side, a ballast unit on the middle, and a battery unit at the rear side. These three units are respectively connected in series by means of a respective electric connection structure that is comprised of an end cap 115 and an end plate 122. When the end cap 115 and end plate 122 of each electric connection structure are fastened together, the electric connection structure achieves electric connection and prevents leakage of high voltage.

The lamp head unit comprises a lamp case 11, a lamp base 111 mounted in the lamp case 11, a reflector 112 fastened to the front side of the lamp base 111, a HID lamp 113 installed in the lamp base 111 within the reflector 112, a PC board 114 disposed at the rear side of the lamp base 111 and having a positive contact 1142 at the center and a negative contact 1141 at one side and an independent contact 1143, one end cap 115 provided at the rear side of the PC board 114. The end cap 115 comprises three holes 1151, 1152, 1153 corresponding to the three contacts 1141~1143 of the PC board 114, three metal springs 11512, 11522, 11532 respectively mounted in the holes 1151, 1152, 1153 and respectively connected to the contacts 1141~1143 of the PC board 114, and three metal conducting pins 11511, 11521, 11531 respectively supported on the metal springs 11512, 11522, 11532. The positive and negative contacts 1142, 1141 are respectively connected to the metal conducting pins 11511, 11521 to conduct electricity, and the independent contact 1143 is connected to the metal conducting pin 11531 to keep the connection in balance with no electricity. The end cap 115 further comprises a front inner annular flange 1155 protruded from the front side at the center, a front outer annular flange 1154 protruded from the front side at the center and concentrically spaced around the front inner annular flange 1155, an annular coupling groove 1156 defined between the front outer annular flange 1154 and the front inner annular flange 1155. The ballast unit comprises a housing 12, a ballast 121 mounted in the housing 12 for boosting voltage, a power switch 127 mounted in the housing 12 at one side for operation by the hand holding the HID searchlight module 1 to switch on/off power supply, and an end plate 122 at the front side for the connection of the end cap 115 at the lamp head unit. The end plate 122 comprises a circular center groove 1222, an annular groove 1221 concentrically disposed around the circular center groove 1222, an annular flange 1224 disposed between the annular groove 1221 and the circular center groove 1222, an annular contact plate 123 mounted in the annular groove 1221, a metal contact 1223 mounted in the circular center groove 1222. The ballast 121 has its positive and negative terminals respectively and electrically connected to the metal contact 1223 and the annular contact plate 123. When the lamp case 11 of the front lamp head unit is connected to the front side of the housing 12 of the ballast unit by means of threading the inner threads of the lamp case 11 onto the outer threads of the housing 12, the front inner annular flange 1155 and front outer annular flange 1154 of the end cap 115 are respectively engaged into the circular center groove 1222 and annular groove 1221 of the end plate 122, and the metal conducting pins 11521, 11511 of the end cap 115 are forced into contact with the metal contact 1223 and annular contact plate 123 of the end plate 122, thereby conducting electricity. At this time, the annular flange 1224 positively isolates the positive pole from the negative pole (see FIG. 3), preventing short-circuit.

The battery unit comprises a housing 13, a battery 132 mounted in the housing 13. The housing 13 of the battery unit is threaded into the rear end of the housing 12 of the ballast unit. The housing 12 of the ballast unit has its rear end mounted with a partition plate 125. The partition plate 125 is provided with three metal contacts 1251, 1252, 1253. The ballast 121 has its power input positive terminal and power input negative terminal respectively electrically connected to the metal contact 1252 at the center of the partition plate 125 and the metal contact 1521 at one side of the partition plate 125. The end cap 115 and end plate 124 of the electric connection structure between the ballast unit and the battery unit are respectively provided at the rear side of the housing 12 of the ballast unit and the front side of the housing 13 of the battery unit so that the battery power of the battery 132 is provided to the ballast 121. The end plate 124 is provided with an annular contact plate 123 and a center metal contact 1241 respectively disposed in contact with the metal conducting pins 11511, 11521, 11531 of the end cap 115. Further, the lamp case 11 of the lamp head unit has a front mounting portion 141 mounted with a filter lens cap 14. The filter lens cap 14 comprises a filter lens 143, and a flexible plastic cap ring 1431 holding the filter lens 143. The flexible plastic cap ring 1431 is fastened to the front mounting portion 141 of the lamp case 11. The lamp case 11 has a finger notch 142 at the front mounting portion 141. The user can insert a finger into the finger notch 142 to detach the filter lens cap 14 from the lamp case 11. Further, the housing 13 of the battery unit is capped with a cap 133. By means of the aforesaid arrangement, different lengths of housings 13 and 131 for battery unit can be selectively fastened to the housing 12 of the ballast unit (see FIG. 6).

Figure 7:
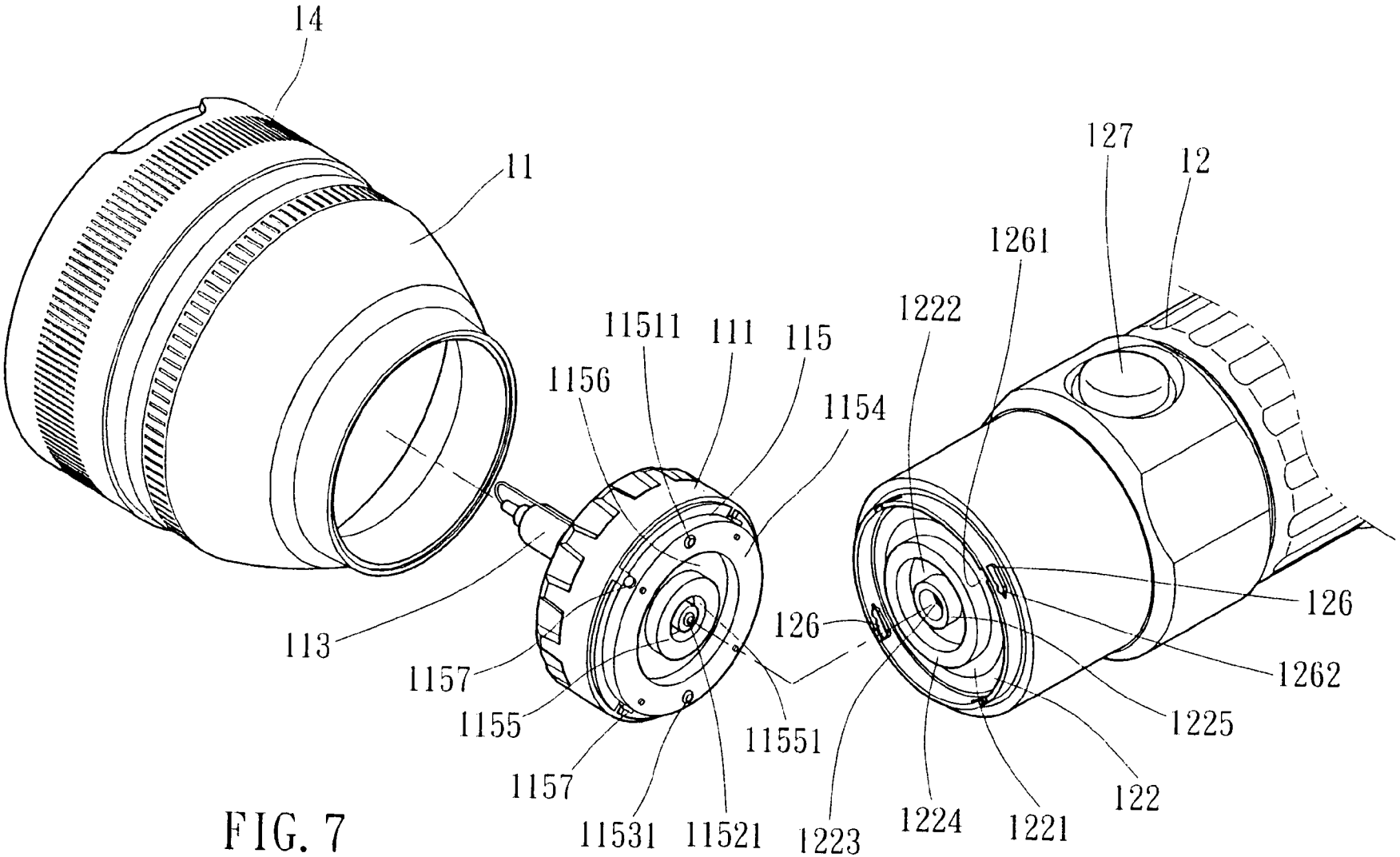
FIG. 7 is an exploded view of a part of a HID searchlight module in accordance with a second embodiment of the present invention.
Figure 8:
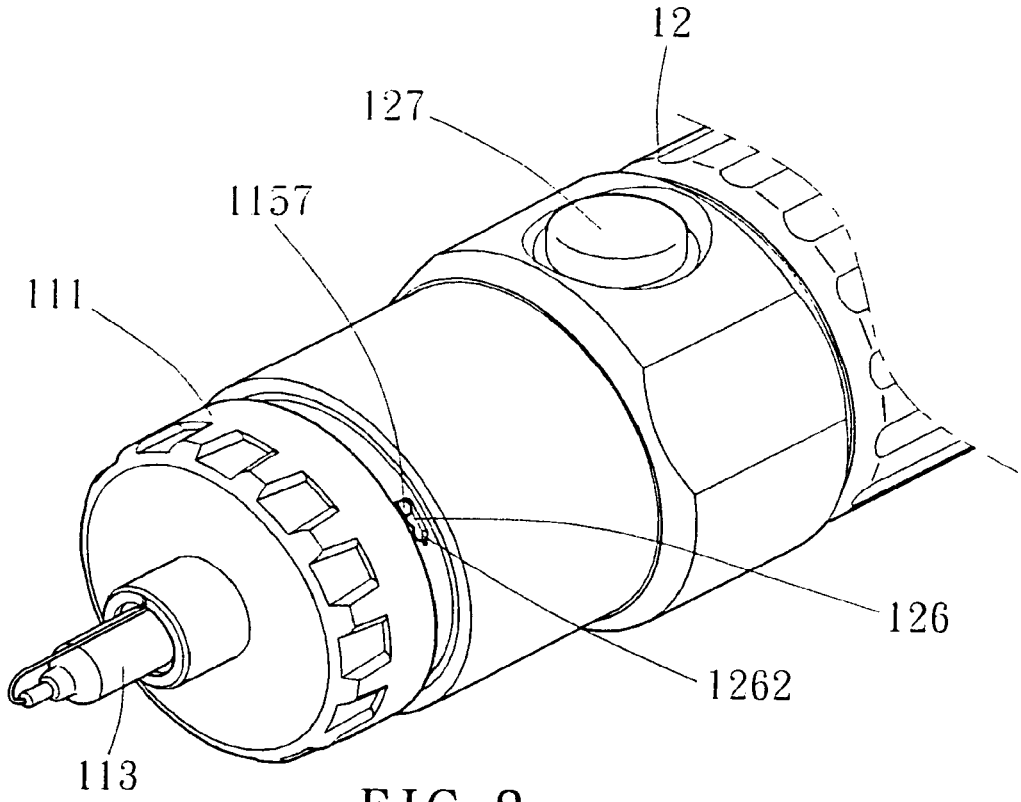
FIG. 8 is a schematic drawing showing the procedure of the connection between the lamp head unit and the ballast unit in accordance with the first second embodiment of the present invention (I).
Figure 9:
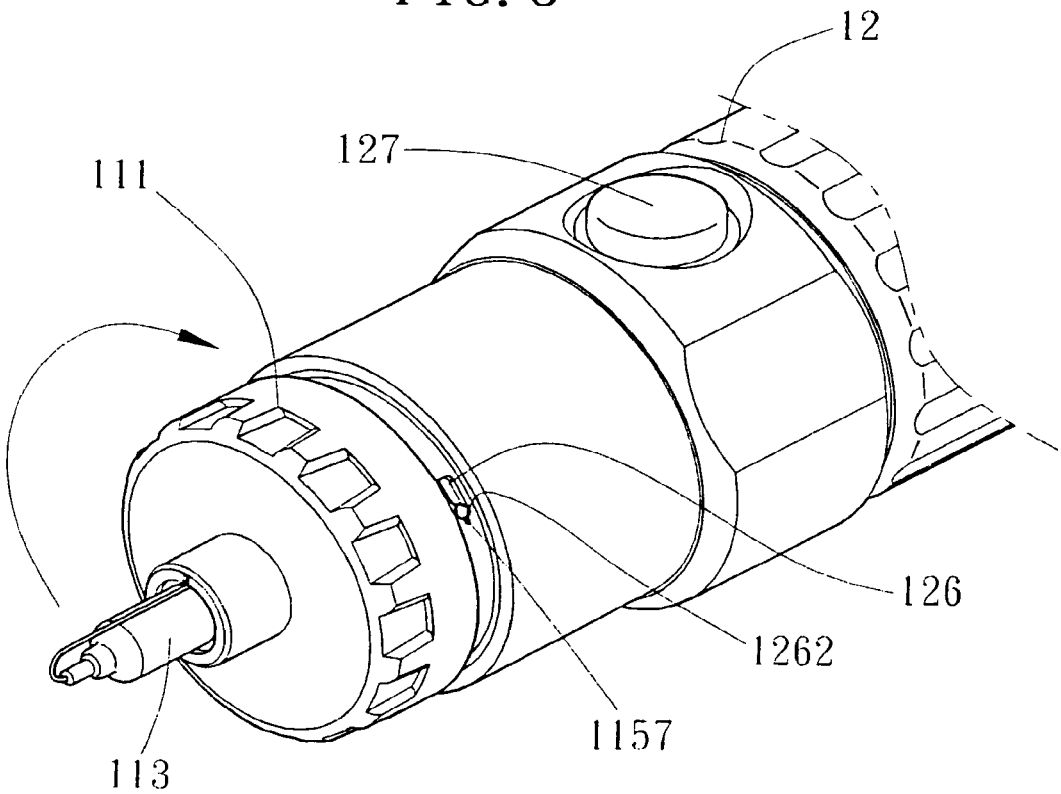
FIG. 9 is a schematic drawing showing the procedure of the connection between the lamp head unit and the ballast unit in accordance with the first second embodiment of the present invention (II).
Figure 10:
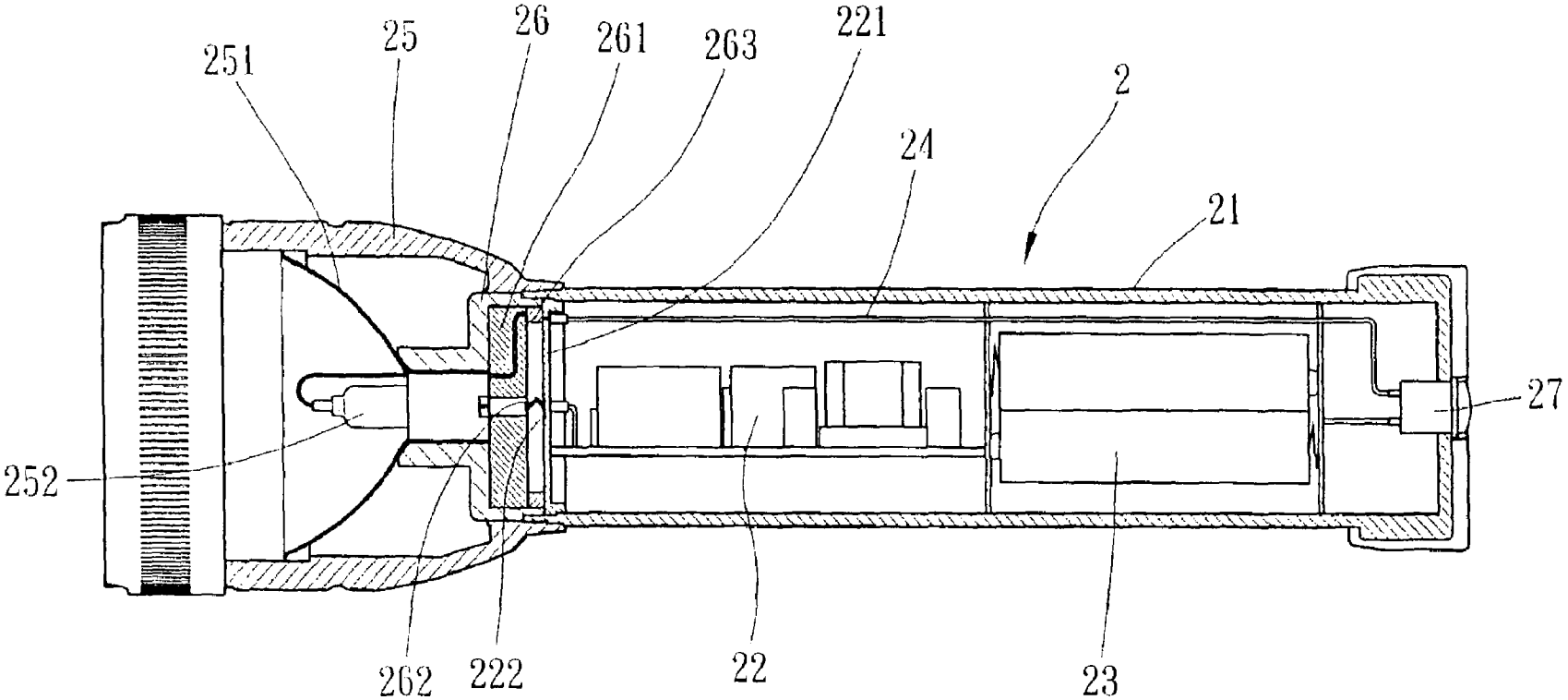
PRIOR ART FIG. 10
FIG. 10 is a sectional view of a HID searchlight according to the prior art.
Figure 11:
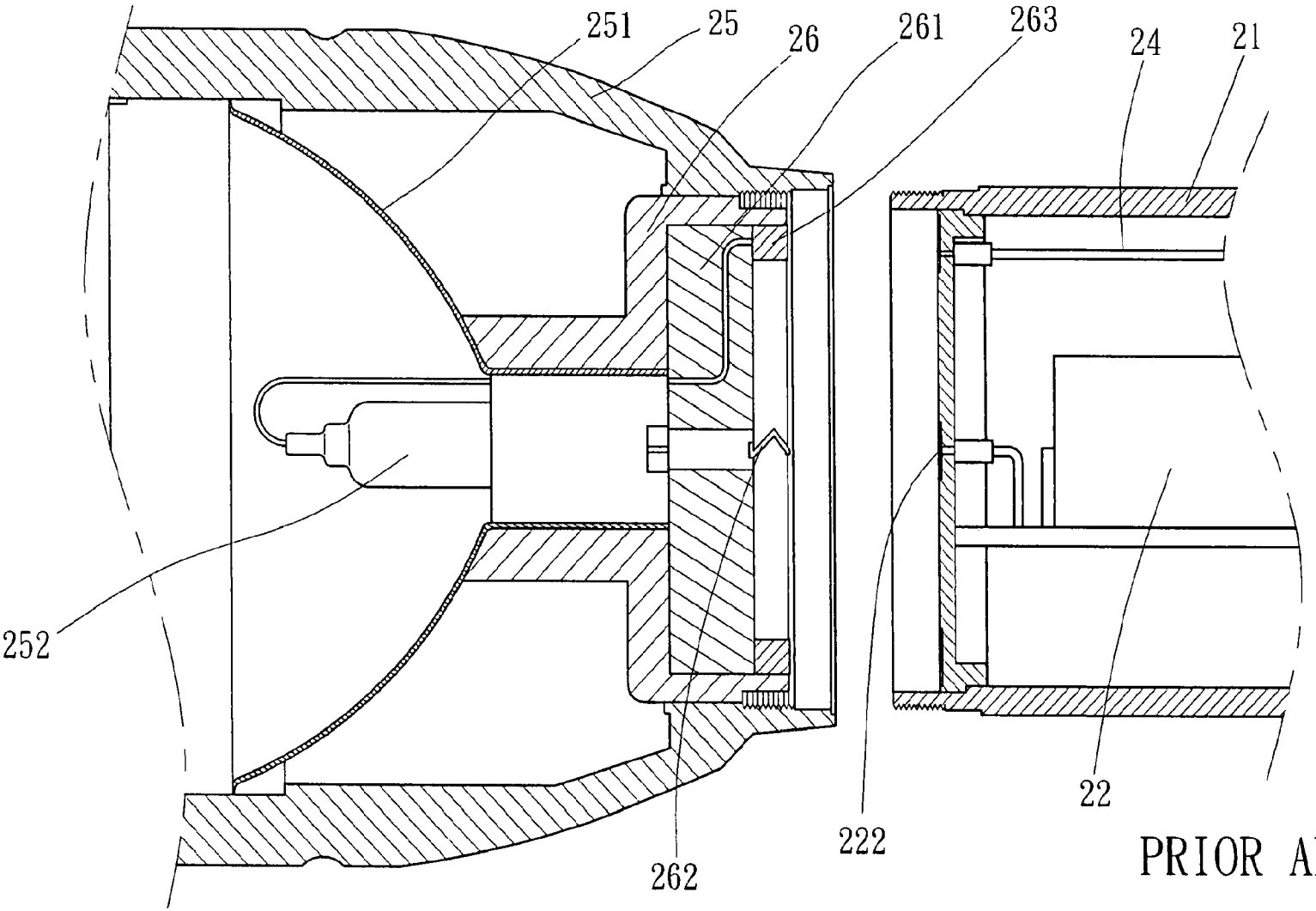
PRIOR ART FIG. 11
FIG. 11 is an exploded view in an enlarged scale of a part of the prior art HID searchlight.

FIGS. 7 and 8 show an alternate form of the present invention. According to this embodiment, the end cap 115 at the rear side of the lamp base 111 of the lamp head unit has a plurality of coupling rods 1157, and the end plate 122 at the front side of the housing 12 of the ballast unit has a plurality of coupling holes 126. Each coupling hole 126 has a notch 1261 at one end and a retaining portion 1262 at the other end. The coupling rods 1157 are respectively inserted through the notches 1261 into the coupling holes 126 and then forced into engagement with the respective retaining portions 1262 upon rotation of the lamp head unit relative to the ballast unit through an angle; Further, the end cap 115 at the rear side of the lamp case 11 of the lamp head unit has an annular groove 11551 disposed around the center metal conducting pin 11521, and the end plate 122 at the front side of the housing 12 of the ballast unit has an annular flange 1225 fitted into the annular groove 11551 to enhance the isolation effect.

Although particular embodiments of the invention have been described in detail for purposes of illustration, various modifications and enhancements may be made without departing from the spirit and scope of the invention.

What the invention claimed is:

1. A HID searchlight module comprising:

a lamp head unit, said lamp head unit comprising a lamp case, a lamp base mounted in said lamp case, a reflector fastened to a front side of said lamp base, a HID lamp installed in said lamp base within said reflector, a PC board disposed at a rear side of said lamp base, said PC board having a positive contact at the center thereof and a negative contact at one side thereof, an lamp head end cap provided at a rear side of said PC board, said lamp head end cap comprising two holes corresponding to the positive and negative contacts of said PC board, two metal springs respectively mounted in the holes and respectively electrically connected to the contacts of said PC board, two metal conducting pins respectively supported on said metal springs, a front inner annular flange protruded from a front side thereof at the center, a front outer annular flange protruded from the front side at the center and concentrically spaced around said front inner annular flange, and an annular coupling groove defined between the front outer annular flange and the front inner annular flange;

a ballast unit connectable to said lamp case in a line, said ballast unit comprising a ballast housing, a ballast mounted in said ballast housing for boosting voltage, a power switch mounted in said ballast housing at one side for operation by the user holding the HID searchlight module to switch on/off power supply, and a ballast unit end plate at a front side of said ballast housing for the connection of said lamp head end cap of said lamp head unit, said ballast unit end plate comprising a circular center groove, which receives the front inner annular flange of said lamp head end cap, an annular groove concentrically disposed around said circular center groove, which receives the front outer annular flange of said lamp head end cap, an annular flange disposed between the annular groove and the circular center groove, an annular contact plate mounted in the annular groove, which is kept in contact with one metal conducting pin of said lamp head end cap, and a metal contact mounted in the circular center groove, which is kept in contact with the other metal conducting pin of said lamp head end cap, said ballast having positive and negative terminals thereof respectively and electrically connected to the metal contact and annular contact plate in said ballast unit end plate; and a battery unit connected to one end of said ballast unit opposite to said lamp head unit, said battery unit comprising a battery housing, a battery mounted in said battery housing.

2. The HID searchlight module as claimed in claim 1, wherein said ballast unit further comprises a partition plate provided at a rear side of said ballast housing and a ballast end cap disposed at a rear side of said partition plate, said partition plate a center metal contact plate and a side metal contact plate respectively electrically connected to positive and negative terminals of said ballast, said ballast unit end cap comprising two holes corresponding to the center metal contact plate and side metal contact plate of said partition plate, two metal springs respectively mounted in the holes and respectively electrically connected to the center metal contact plate and side metal contact plate of said partition plate, two metal conducting pins respectively supported on said metal springs, a front inner annular flange protruded from a front side thereof at the center, a front outer annular flange protruded from the front side at the center and concentrically spaced around the front inner annular flange of said ballast unit end cap, an annular coupling groove defined between the front outer annular flange and front inner annular flange of said ballast unit end cap; said battery unit comprises a battery unit end plate at a front side of said battery housing for the connection of said ballast unit end cap of said ballast unit, said battery unit end plate comprising a circular center groove, which receives the front inner annular flange of said ballast unit end cap, an annular groove, which receives the front outer annular flange of said ballast unit end cap, an annular flange disposed between the annular groove and circular center groove of said battery unit end plate, an annular contact plate mounted in the annular groove of said battery unit end plate and kept in contact with one metal conducting pin of said ballast unit end cap, and a metal contact mounted in the circular center groove of said battery unit end plate and kept in contact with the other metal conducting pin of said ballast unit end cap, said battery having positive and negative terminals thereof respectively and electrically connected to the metal contact and annular contact plate in said battery unit end plate.

3. The HID searchlight module as claimed in claim 1, wherein said lamp case has inner threads threaded onto outer threads at one end of said ballast housing.

4. The HID searchlight module as claimed in claim 1, wherein said PC board has an independent contact; said lamp head end cap comprises a third hole, a metal spring mounted in said third hole and connected to the independent contact of said PC board, and a metal contact pin supported on the metal spring in said third hole.

5. The HID searchlight module as claimed in claim 2, wherein said ballast housing has inner threads at a rear side thereof; said battery housing has outer threads disposed at a front side thereof and threaded into the inner threads of said ballast housing.

6. The HID searchlight module as claimed in claim 1, wherein said lamp case of said lamp head unit has a front mounting portion, a finger notch on said front mounting portion, and a filter lens cap capped on said front mounting portion, said filter lens cap comprising a filter lens and a flexible rubber ring holding said filter lens and capped on said front mounting portion of said lamp case.

7. The HID searchlight module as claimed in claim 1, wherein said lamp head end cap of said lamp head unit comprises a plurality of coupling rods, and said ballast unit end plate of said ballast unit comprises a plurality of coupling holes respectively coupled to said coupling rods of said lamp head end cap, each said coupling hole having a notch at one end thereof for guiding in the associating coupling rod of said lamp head end cap and a retaining portion at an opposite end thereof for securing the associating coupling rod of said lamp head end cap in place.

8. The HID searchlight module as claimed in claim 1, wherein said lamp head end cap has an annular groove disposed around the metal conducting pin at the center of said lamp head end cap; said ballast unit end plate of said ballast unit has an annular flange fitted into the annular groove of said lamp head end cap.

* * * * *